US009358678B2

(12) United States Patent
Lai

(10) Patent No.: US 9,358,678 B2
(45) Date of Patent: Jun. 7, 2016

(54) TELESCOPIC RATCHET WRENCH

(71) Applicant: Shih-Hao Lai, Taichung (TW)

(72) Inventor: Shih-Hao Lai, Taichung (TW)

( * ) Notice: Subject to any disclaimer, the term of this patent is extended or adjusted under 35 U.S.C. 154(b) by 253 days.

(21) Appl. No.: 14/229,995

(22) Filed: Mar. 31, 2014

(65) Prior Publication Data

US 2015/0273680 A1 Oct. 1, 2015

(51) Int. Cl.
*B25G 1/04* (2006.01)
*B25B 13/46* (2006.01)

(52) U.S. Cl.
CPC ..... *B25G 1/043* (2013.01); *B25B 13/461* (2013.01)

(58) Field of Classification Search
CPC ..... B25G 1/043; B25G 1/01; B25G 1/105; B25B 13/461; Y10T 16/473
See application file for complete search history.

(56) References Cited

U.S. PATENT DOCUMENTS 6,959,629 B2 * 11/2005 Hsien ..... B25B 13/04 403/109.3
7,188,553 B1 * 3/2007 Pryor ..... B25G 1/043 81/177.2
7,434,495 B2 * 10/2008 Lin ..... B25B 13/461 16/429
7,497,149 B2 * 3/2009 Lin ..... B25B 13/461 403/109.3
8,266,989 B2 * 9/2012 Hu ..... B25B 13/461 81/177.1
8,297,155 B2 * 10/2012 Hu ..... B25B 23/0035 403/328
2007/0186730 A1 * 8/2007 Chen ..... B25B 13/461 81/177.2
2009/0090224 A1 * 4/2009 Lin ..... B25G 1/043 81/177.2

* cited by examiner

*Primary Examiner* — David B Thomas

(57) ABSTRACT

A ratchet wrench includes a telescopic handle that includes a shank, a tube and a positioning unit. The shank includes bores. The tube is movably supported on the shank and includes an aperture. The positioning unit includes a shell, a button, a spring and a ball. The shell is supported on the tube and includes a pocket. The button is movably inserted in the pocket and includes a shallow recess and a deep recess. A first portion of the ball enters one of the bores via the aperture when a second portion of the ball is placed in the shallow recess as the button is kept in an upper position by the spring. The button can be pushed to allow the second portion of the ball to enter the deep recess so that the first portion of the ball can escape from any of the bores.

17 Claims, 8 Drawing Sheets

TELESCOPIC RATCHET WRENCH

BACKGROUND OF INVENTION

1. Field of Invention

The present invention relates to a ratchet wrench and, more particularly, to a telescopic ratchet wrench.

2. Related Prior Art

A ratchet wrench includes a handle, a head formed at an end of the handle, and a ratchet-like mechanism placed in the head. The ratchet-like mechanism includes a non-circular tongue for insertion in a corresponding bore made in a socket. The socket is engaged with a nut or a head of a threaded bolt. By operating the combination of the ratchet wrench with the socket, the nut or the threaded bolt is tightened or loosened.

Conventionally, the handle is made with a fixed length. By exerting a force on the handle, a larger torque is produced if the handle extends longer. However, it is less convenient to operate the one-way wrench if the handle extends longer.

The handle can be made in a telescopic configuration that includes a shank, a grip movably connected to the rod, and a positioning unit for positioning the grip on the shank. The positioning unit is supported on the grip and made with a portion for engagement with the shank. The positioning unit is switched in a longitudinal direction of the grip between a locking position and a releasing position. The switching of the positioning unit is however complicated.

Moreover, it is a gap between the shank and the grip. The gap could be too small to smoothly move the grip on the shank. The gap could be too large to keep the grip in line with the shank. It requires high precision to make the shank and the grip so that the gap is properly sized. To reach high precision, a complicated process that includes quite a few steps must be run. Such a complicated process takes a lot of time and costs a lot of money.

Moreover, the ratchet wrench is inevitably dropped onto the ground or a floor from time to time. The ratchet wrench and/or the ground or floor might get damaged.

The present invention is therefore intended to obviate or at least alleviate the problems encountered in prior art.

SUMMARY OF INVENTION

It is the primary objective of the present invention to provide a ratchet wrench with a reliable, smooth telescopic handle.

To achieve the foregoing objective, the telescopic handle includes a shank, a tube and a positioning unit. The shank includes a longitudinal groove and bores located in the longitudinal groove. The tube is movably supported on the shank and includes at least one aperture. A ring is placed between the shank and the tube. The positioning unit includes a shell, a button, a spring and a ball. The shell is supported on the tube and formed with a pocket. The button is movably inserted in the pocket and includes a shallow recess and a deep recess. The ball includes a first portion movable along the longitudinal groove and a second portion placed against the button. The first portion of the ball enters one of the bores via the aperture when the spring pushes the button into an upper position to place the second portion of the ball in the shallow recess. The first portion of the ball can escape from any of the bores when the button is pushed to allow the second portion of the ball to enter the deep recess.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
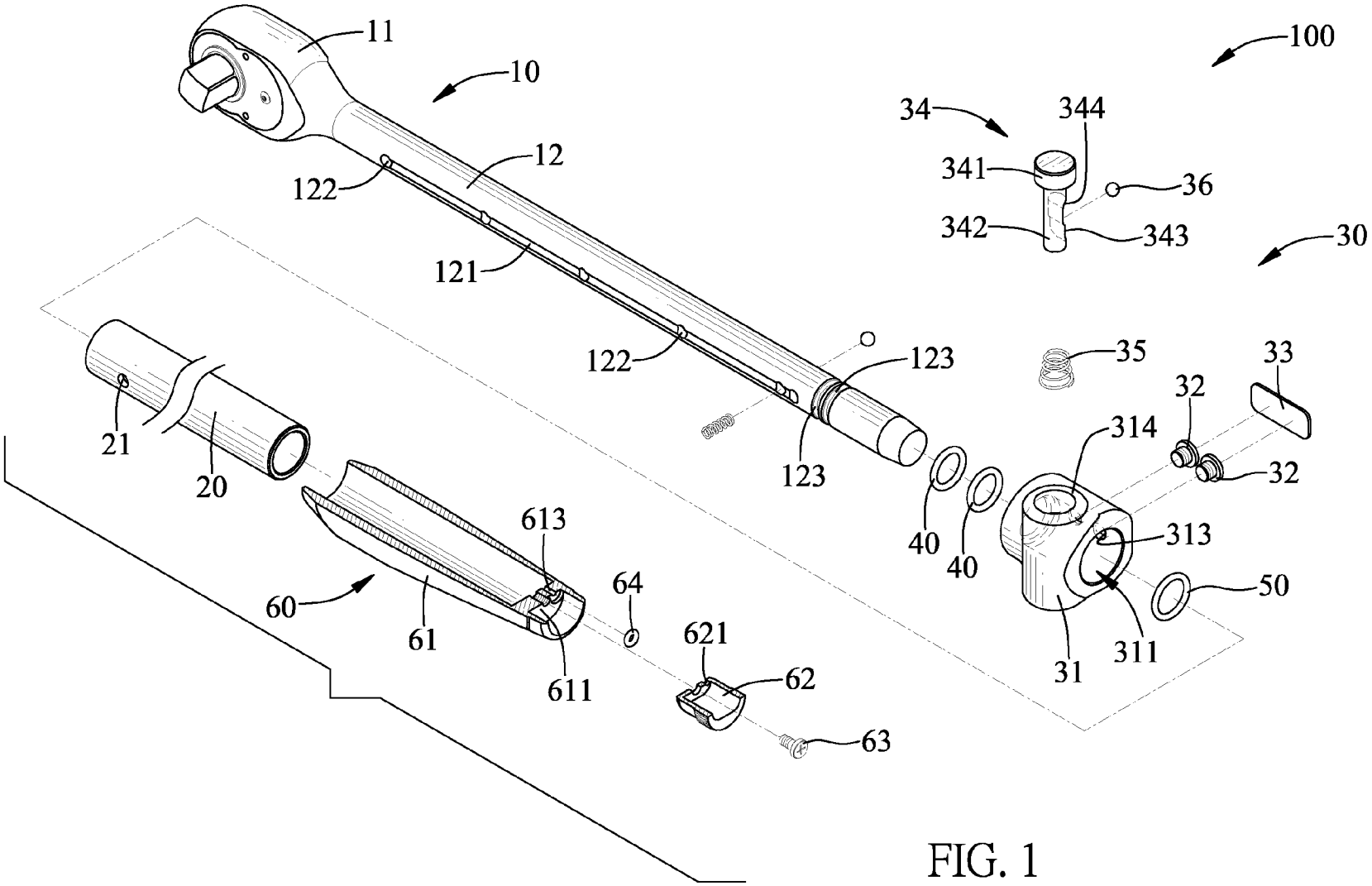
FIG. 1 is an exploded view of a telescopic ratchet wrench according to the preferred embodiment of the present invention.
Figure 2:
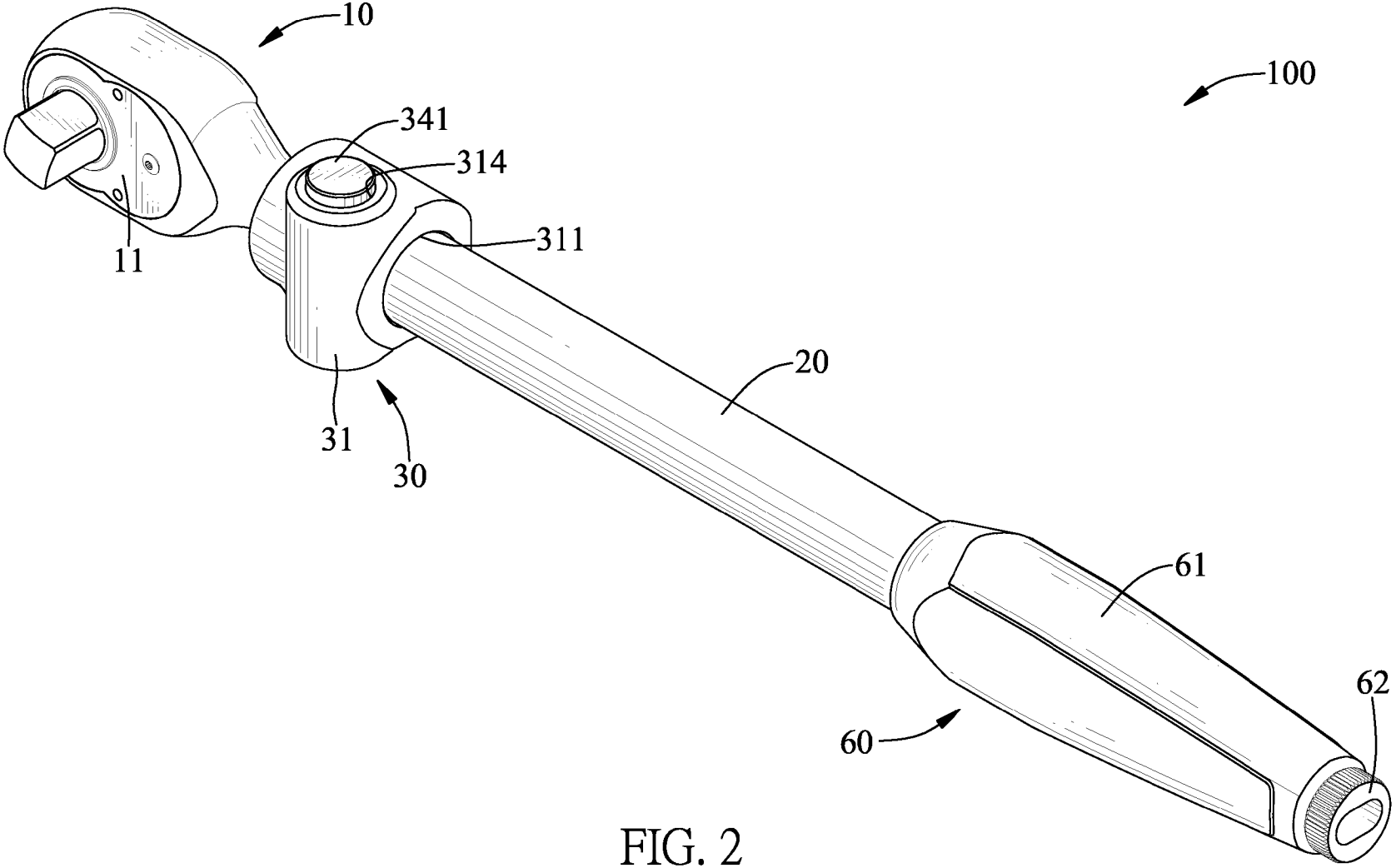
FIG. 2 is a perspective view of the telescopic ratchet wrench of FIG. 1.

Referring to FIGS. 1 and 2, a ratchet wrench 100 includes a telescopic handle 10 and a cushioning unit 60 according to the preferred embodiment of the present invention. The telescopic handle 10 includes a head 11, a shank 12, a tube 20 and a positioning element 30. The head 11 is formed at an end of the shank 12. It should be known that a ratchet-like mechanism is placed in the head 11 although it is not shown. The shank 12 includes a longitudinal groove 121, bores 122 evenly located in the longitudinal groove 121, and two annular grooves 123 made near another end.

The tube 20 includes an aperture 21. The aperture 21 is made with a diameter identical to that of the bores 12.

The positioning unit 30 includes a shell 31, two screws 32, a decorative strip 33, a button 34, a spring 35 and a ball 36. The shell 31 includes a tunnel 311, a cavity 312, two screw holes 313, a pocket 314, and an internal annular groove 317. The tunnel 311 is in communication with the screw bores 313, the pocket 314 and the internal annular groove 317. The tunnel 311 extends horizontally while the pocket 314 extends horizontally. The cavity 312 is made in an external side of the shell 31. The screw bores 313 are located in the cavity 312.

Figure 4:
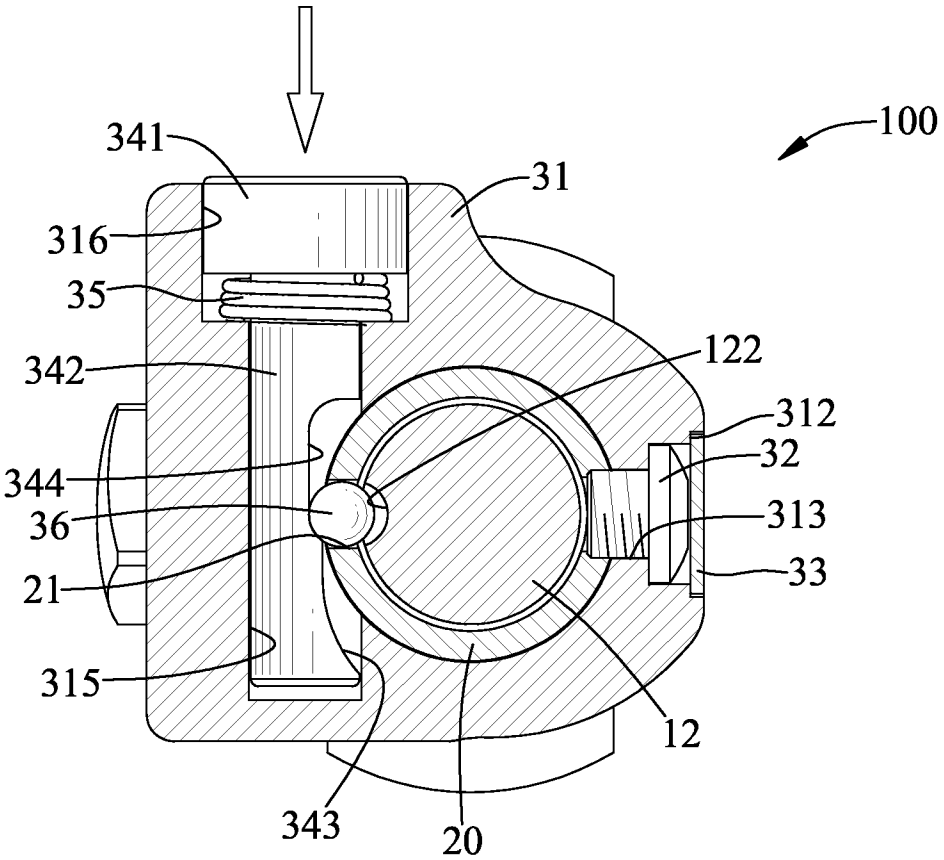
FIG. 4 is another cross-sectional view of the telescopic ratchet wrench shown in FIG. 2.
Figure 6:
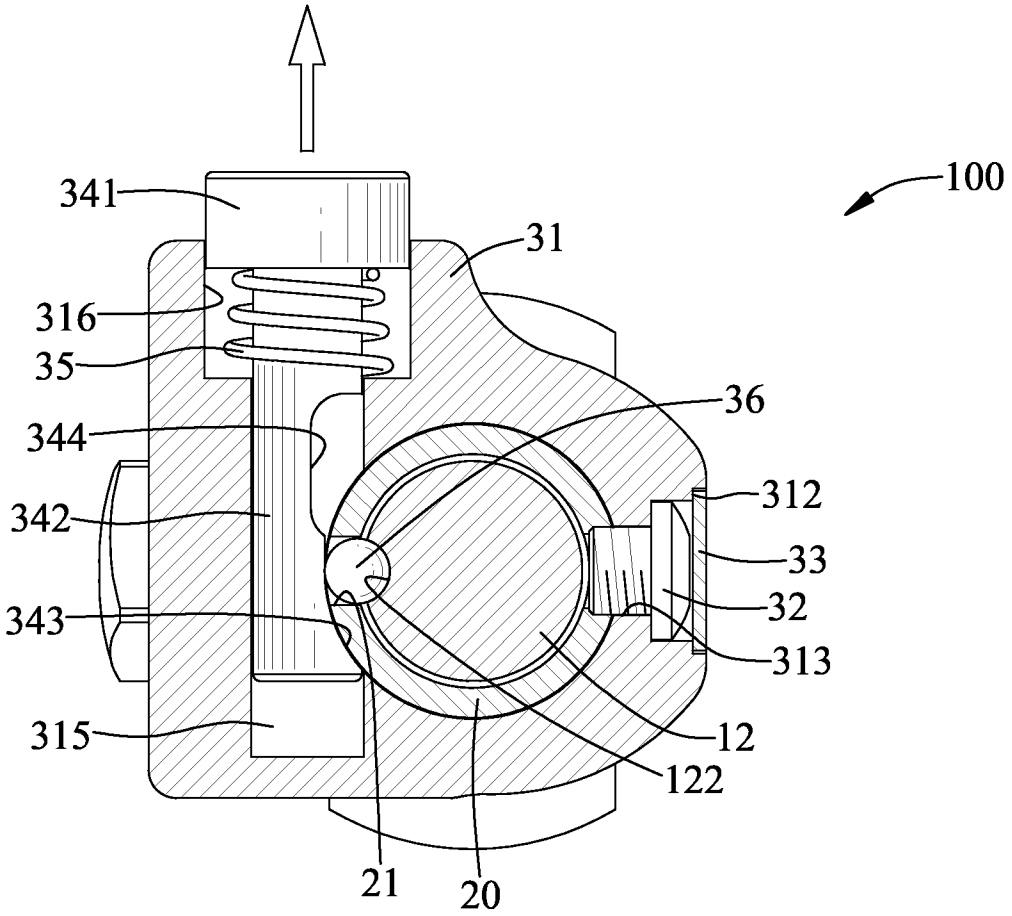
FIG. 6 is a cross-sectional view of the telescopic ratchet wrench in another position than shown in FIG. 4.

Referring to FIGS. 4 and 6, the pocket 314 includes a lower portion 315 and an upper portion 316. The lower portion 315 is made with a diameter smaller than that of the upper portion 316. Thus, there is shoulder (not numbered) between the lower portion 315 and the upper portion 316. The lower portion 315 of the pocket 314 is in communication with the tunnel 311.

The button 34 includes a head 341, a body 342 and a shoulder (not numbered) formed between the head 341 and the body 342. The head 341 is made with a diameter larger than that of the body 342. The body 342 is made with a shallow recess 343 and a deep recess 344. The shallow recess 343 is in communication with the deep recess 344.

The cushioning unit 60 includes a grip 61, a knob 62, a screw 63 and a ring 64. The grip 61 includes an internal disc 611. The internal disc 611 includes a screw hole (not numbered) centrally made therein and an aperture 613 eccentrically made therein.

The knob 62 includes a disc (not numbered) formed at an end. The disc includes an aperture (not numbered) centrally made therein and another aperture 621 eccentrically. The aperture 621 is made with a diameter identical to that of the aperture 613.

Two rings 40 are placed in the annular grooves 123 before the tube 20 is movably supported on the shank 12. The aperture 21 is aligned with the longitudinal groove 121 as shown in FIGS. 4 and 6.

Figure 3:
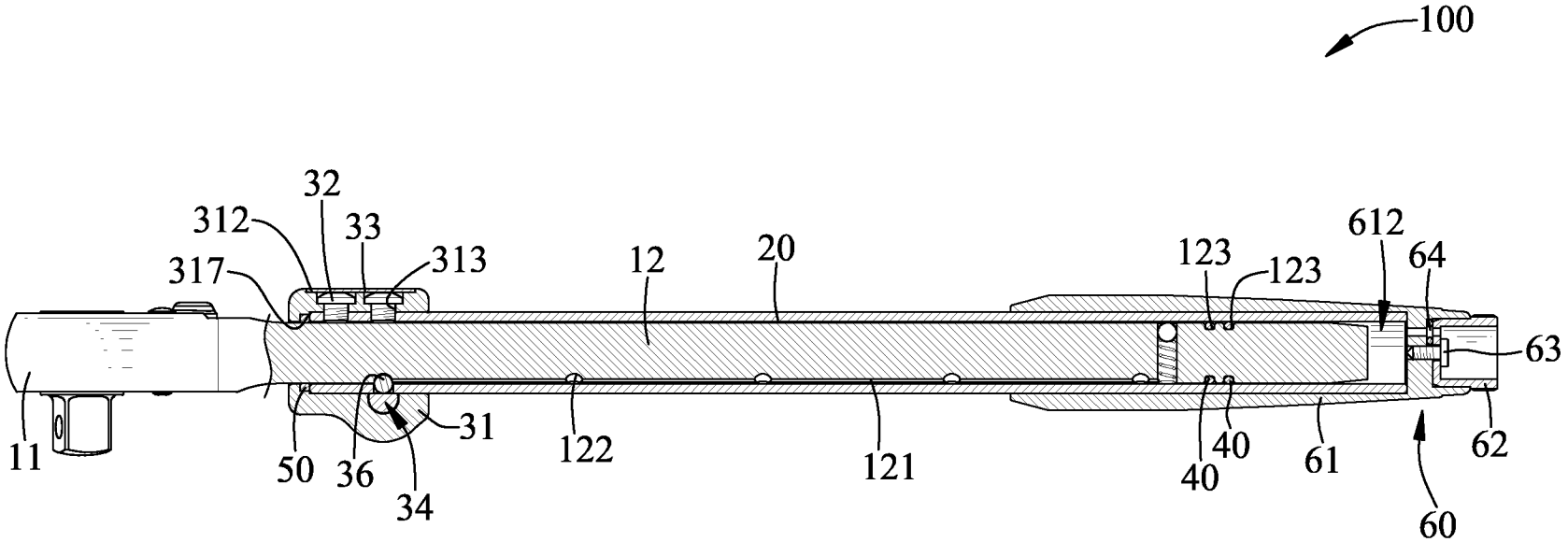
FIG. 3 is a cross-sectional view of the telescopic ratchet wrench shown in FIG. 2.
Figure 5:
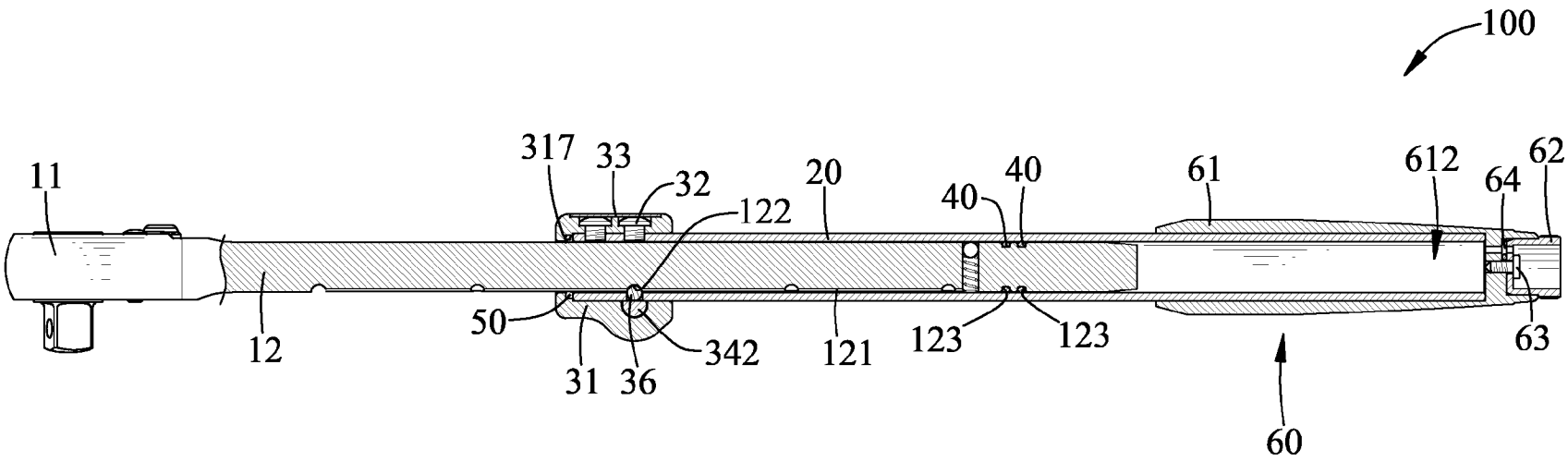
FIG. 5 is a cross-sectional view of the telescopic ratchet wrench in another position than shown in FIG. 3.

A ring 50 is placed in the internal annular groove 317. Then, the shell 31 is placed on the tube 20 so that the tube 20 extends throughout the tunnel 311 as shown in FIGS. 3 and 5. The screws 32 are inserted throughout the screw holes 313. The tips of the screws 32 are placed against the tube 20 to attach the shell 31 to the tube 20 so that the shell 31 and the tube 20 are moveable together on the shank 12. The decorative strip 33 is placed in the cavity 312 to cover the heads of the screws 32.

The button 34 is inserted in the pocket 314. The head 341 of the button 34 is placed in the upper portion 316 of the pocket 314 while the body 342 of the button 34 is placed in the lower portion 315 of the pocket 314. The spring 35 is located between the shoulder of the button 34 and the shoulder of the pocket 314. Thus, button 34 is biased upwards relative to the shell 31 by the spring 35.

The grip 61 is movably supported on the tube 20. The knob 62 is rotationally connected to the grip 61 by inserting the screw 63 in the screw hole of the disc 611 of the grip 61 through the central aperture of the knob 62. The ring 64 is placed between the disc 611 of the grip 61 and the knob 62. The ring 64 is placed in a cavity (not numbered) around and in communication with the aperture 613.

The telescopic handle 10 can be switched between a shrunk position as shown in FIG. 3 and an extended position as shown in FIG. 4. In the shrunk position of the telescopic handle 10, the tube 20 is placed near the head 11. The effective length of the telescopic handle 10 is small. In the extended position of the telescopic, the tube 20 is placed far from the head 11. The effective length of the telescopic handle 10 is large. The tube 20 moves smoothly on the shank 12 and they do not pivot relative to each other because of the rings 40 and 50.

The button positioning unit 30 can be maneuvered to allow the telescopic handle 10 to enter the shrunk position, the extended position or any intermediate position. These positions are determined by the bores 122.

Referring to FIG. 4, the button 34 is pushed by an external force, with the spring 35 compressed. The ball 36 is allowed to enter the deep recess 344. That is, the ball 36 is allowed to escape from a current bore 122. Hence, the tube 20 is allowed to move on the shank 12.

Figure 7:
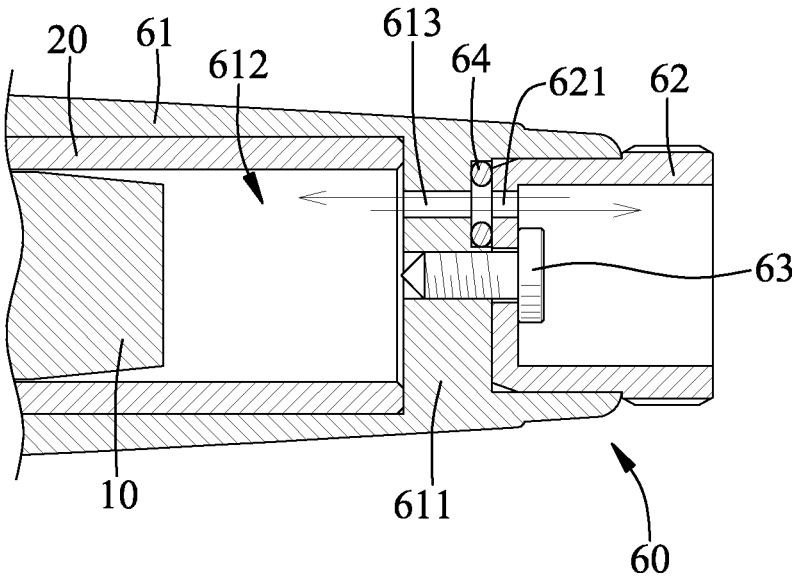
FIG. 7 is a partial, cross-sectional view of the telescopic ratchet wrench shown in FIG. 2.
Figure 8:
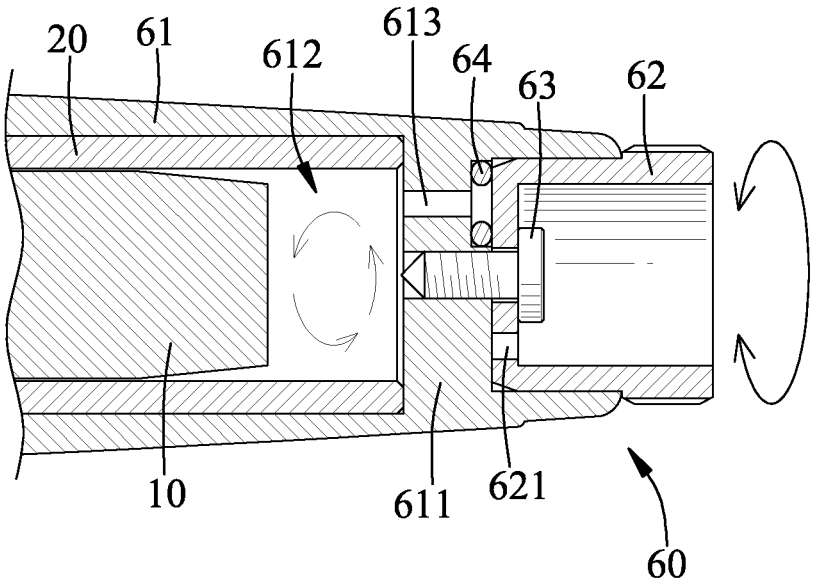
FIG. 8 is a partial, cross-sectional view of the telescopic ratchet wrench in another position than shown in FIG. 7.
Figure 9:
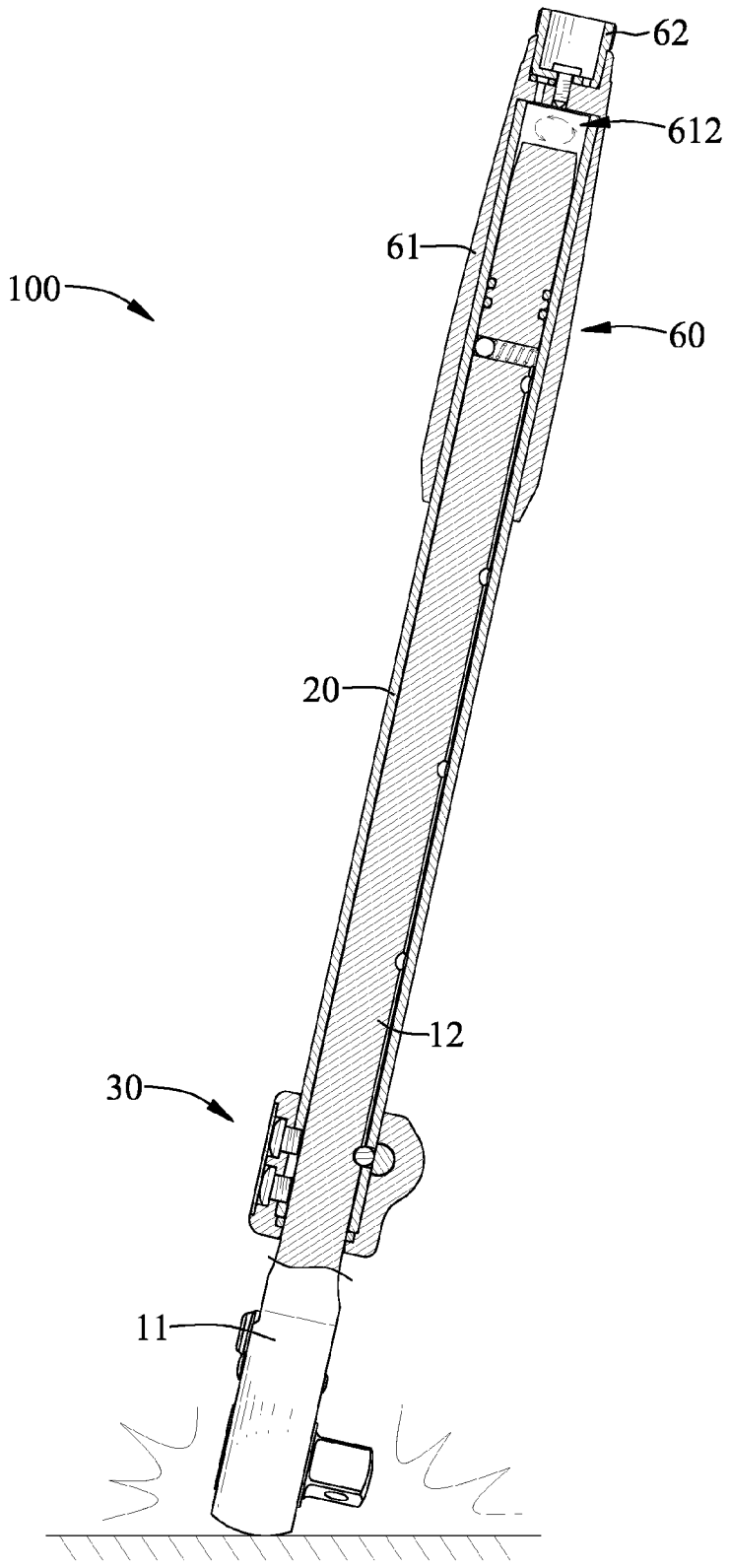
FIG. 9 is a cross-sectional view of the telescopic ratchet wrench shown in FIG. 2 dropped onto the ground.

Referring to FIG. 6, the external force is stopped, and the spring 35 tends to move the button 34 upwards. The tube 20 is movable on the shank 12 until the ball 36 enters another bore 122. As the ball 36 enters the bore 122, the spring 35 actually moves the button 34 upwards so that the ball 36 enters the shallow recess 343. The ball 36 is retained in the shallow recess 343 as the button 34 is kept in the upper position by the spring 35. Hence, the ball 36 is kept in the bore 122. Accordingly, the tube 20 is positioned on the shank 12. Referring to FIGS. 7 through 9, a space 612 is defined by the shank 12, the tube 20 and the grip 61. Referring to FIG. 7, the knob 62 is in a position relative to the grip 61 so that the aperture 621 is in communication with the aperture 613. Air is allowed to travel into and out of the space 612 through the apertures 621 and 613. That is, there is no difference in air pressure between the space 612 and the atmosphere in any attempt to move the tube 20 on the shank 12. Therefore, the movement of the tube 20 on the shank 12 is easy.

Referring to FIG. 8, the knob 62 is in another position relative to the grip 61 so that the aperture 621 is isolated from the aperture 613. Accordingly, air is not allowed to travel into and out of the space 612 through the apertures 621 and 613. That is, there is at least a temporary difference in air pressure between the space 612 and the atmosphere in an attempt to move the tube 20 on the shank 12. Therefore, the movement of the tube 20 on the shank 12 is damped.

With the air trapped in the space 612, the shank 12, the tube 20 and the grip 61 together perform like a pneumatic cushion that can cushion an impact on the ratchet wrench 100 when the ratchet wrench 100 falls onto the ground as shown in FIG. 9.

Advantageously, the arrangement of the button 34 in the shell 31 enables a user to operate the positioning unit 30 instinctively. Moreover, the rings 40 and 50 guarantee smooth movement of the tube 20 on the shank 12. In addition, the cushioning unit 60 cushions and protects the ratchet wrench 100 in a case where the ratchet wrench 100 is dropped onto the ground or a floor by accident.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A ratchet wrench including a telescopic handle 10 including:

- a shank 12 including a longitudinal groove 122 and bores 122 located in the longitudinal groove 122;
- a tube 20 movably supported on the shank 12, wherein the tube 20 includes an aperture 21;
- a first ring 40 placed between the shank 12 and the tube 20; and
- a positioning unit 30 including:
  - a shell 31 supported on the tube 20 and formed with a pocket 314;
  - a button 34 movably inserted in the pocket 314, wherein the button 34 includes a shallow recess 343 and a deep recess 344;
  - a spring 35 for biasing the button 34; and
  - a ball 36 including a first portion movable along the longitudinal groove 121 and a second portion placed against the button 34, wherein the first portion of the ball 36 enters one of the bores 122 via the aperture 21 to position the tube 20 on the shank 12 when the spring 35 pushes the button 34 into an upper position to place the second portion of the ball 36 in the shallow recess 343, wherein the first portion of the ball 36 can escape from any of the bores 122 to allow the tube 20 to move on the shank 12 when the button 34 is pushed to allow the second portion of the ball 36 to enter the deep recess 344.

2. The ratchet wrench according to claim 1, wherein the shell 31 includes a tunnel 311 in communication with the pocket 314, wherein the tube 20 extends throughout the tunnel 311.

3. The ratchet wrench according to claim 1, wherein the positioning unit 30 includes at least one screw 32 for connecting the shell 31 to the tube 20.

4. The ratchet wrench according to claim 3, wherein the shell 31 includes a screw hole 313, wherein the screw 32 extends throughout the screw hole 313.

5. The ratchet wrench according to claim 3, wherein the positioning unit 30 includes a decorative strip 33 for covering the screw 32.

6. The ratchet wrench according to claim 5, wherein the shell 31 includes a cavity 312 for receiving the decorative strip 33.

7. The ratchet wrench according to claim 1, wherein the pocket 314 includes an upper portion 316 and a lower portion 315 made with a diameter smaller than that of the upper portion 316, wherein the button 34 includes a head 341 and a body 342 made with a diameter smaller than that of the head 341, wherein the spring 35 includes an end in contact with the head 341 and another end in contact with a portion of the shell 311 between the upper and lower portions 316/315 of the pocket 314.

8. The ratchet wrench according to claim 7, wherein the deep and shallow recesses 344/343 are made in the body 342.

9. The ratchet wrench according to claim 1, including a second ring 50 placed between the shank 12 and the shell 31.

10. The ratchet wrench according to claim 9, wherein the shell 31 includes an internal annular groove 317 for receiving the second ring 50.

11. The ratchet wrench according to claim 1, wherein the shank 12 includes an annular groove 123 for receiving the first ring 40.

12. The ratchet wrench according to claim 1, including a cushioning unit 60 connected to the tube 20.

13. The ratchet wrench according to claim 12, wherein the cushioning unit 60 includes:

a grip 61 movably supported on the tube 20 to define a space 612, wherein the grip 61 includes an aperture 613 in communication with the space 612; and a knob 62 rotationally connected to the grip 61 between an idle position and an active position, wherein the knob 62 includes an aperture 621, wherein the aperture 621 of the knob 62 is in communication with the aperture 613 of the grip 61 in the idle position of the knob 62, wherein the aperture 621 of the knob 62 is isolated from the aperture 613 of the grip 61 in the active position of the knob 62.

14. The ratchet wrench according to claim 13, wherein the cushioning unit 60 includes a screw 63 for rotationally connecting the knob 62 to the grip 61.

15. The ratchet wrench according to claim 14, wherein the grip 61 includes a disc 611 formed therein, wherein the screw 63 is inserted in the disc 611.

16. The ratchet wrench according to claim 15, wherein the cushioning unit 60 includes a ring 64 placed between the disc 611 and the knob 62.

17. The ratchet wrench according to claim 16, wherein the ring 64 extends around the aperture 613 of the grip 61.

* * * * *